US005651641A

United States Patent [19]

Stephens et al.

[11] Patent Number: 5,651,641

[45] Date of Patent: Jul. 29, 1997

[54] GEOSYNTHETICS

[75] Inventors: Thomas C. Stephens; Teri L. Frauenfelder Krock, both of Lawrenceville, Ga.

[73] Assignee: Nicolon Corporation, Norcross, Ga.

[21] Appl. No.: 455,147

[22] Filed: May 31, 1995

[51] Int. Cl.[6] ..... B32B 5/02; E02D 17/20; D05C 17/00

[52] U.S. Cl. ..... 405/258; 428/92

[58] Field of Search ..... 405/258; 428/92, 428/93, 95, 96, 109, 111, 247, 255; 264/291; 47/1.01, 9

[56] References Cited

U.S. PATENT DOCUMENTS

| | | | |
|---|---|---|---|
| 763,503 | 6/1904 | McGregor | 405/19 |
| 3,315,408 | 4/1967 | Fisher | 47/9 |
| 3,517,514 | 6/1970 | Visser | 405/19 |
| 3,928,696 | 12/1975 | Wandel et al. | 428/102 |
| 3,935,046 | 1/1976 | Kiernan et al. | 156/48 |
| 4,181,450 | 1/1980 | Rasen et al. | 405/19 |
| 4,353,946 | 10/1982 | Bowers | 428/109 |
| 4,610,568 | 9/1986 | Koerner | 405/19 |
| 4,787,776 | 11/1988 | Brady et al. | 405/258 X |
| 4,849,270 | 7/1989 | Evans et al. | 428/85 |
| 4,916,855 | 4/1990 | Halliday et al. | 405/258 X |
| 4,960,349 | 10/1990 | Willibey et al. | 405/258 X |
| 5,064,313 | 11/1991 | Risi et al. | 405/258 X |
| 5,232,759 | 8/1993 | Golze | 428/92 X |
| 5,249,893 | 10/1993 | Romanek et al. | 405/258 |
| 5,358,356 | 10/1994 | Romanek et al. | 405/16 |
| 5,421,123 | 6/1995 | Sakate et al. | 405/258 X |
| 5,455,305 | 10/1995 | Galambos | 428/96 X |
| 5,507,845 | 4/1996 | Molnar et al. | 405/258 X |

FOREIGN PATENT DOCUMENTS

| | | | |
|---|---|---|---|
| 59-134209 | 8/1984 | Japan | 405/15 |

OTHER PUBLICATIONS

Das, Braja M. Principles of Geotechnical Engineering, 3rd ed., PWS Publishing, p. 595 1984.

Deron N. Austin et al., "Classifying Rolled Erosion Control Products," *Erosion Control* (1995), pp. 48–53.

Tim Lancaster et al., "Classifying rolled erosion–control products: a current perspective," *Geotechnical Fabrics Report* (1994), pp. 16–21.

Mirafi Brochure for "'Miramat' Erosion Control/Revegetation Mat (ECRM)" (1992), 6 pages.

*Primary Examiner*—Frank Tsay
*Assistant Examiner*—Tara L. Mayo
*Attorney, Agent, or Firm*—James L. Ewing, IV; Kilpatrick Stockton LLP

[57] ABSTRACT

Tufted mats for a broad variety of erosion control, turf reinforcement, and earth reinforcement applications. The mats are formed of scrim which is tufted, preferably on conventional carpet machinery, with a number of tufted ends in order to provide high tensile strength, greatly porous and flexible mats which may be easily installed, but which contain a number of interstices for capturing root systems, retaining soil, and controlling the flow of water. The properties of the mats may be easily controlled and optimized by controlling the properties and arrangements of the cross machine ends and machine ends forming the scrim if woven (or corresponding ends, filaments or fibers if knitted or nonwoven), as well as the tufted ends which are tufted into the scrim. Therefore, process technology such as settings on conventional weaving and tufting equipment, may be employed to provide cost-effective, customized, lightweight but strong and durable mats for a broad variety of erosion control, turf reinforcement, and earth reinforcement applications.

34 Claims, 12 Drawing Sheets

GEOSYNTHETICS

The present invention relates to tufted/woven, tufted/nonwoven or tufted/knitted geosynthetic mats and structures for a broad variety of erosion control, turf reinforcement and earth reinforcement applications.

BACKGROUND OF THE INVENTION

Architects, engineers, contractors, land owners and legislative initiatives have demanded increasingly sophisticated and efficient erosion control, turf reinforcement and earth reinforcement products. The term "erosion control" is used broadly in this document to refer generally and broadly to processes for restraining the movement of soil or other components of particulate substrates, whether by wind, water or otherwise, while "turf reinforcement" refers generally and broadly to processes for enhancing vegetation and turf cover on particulate substrates. "Earth reinforcement" refers generally and broadly to increasing tensile and/or shear strength of earth or particulate structures, such as in retaining wall structures, steep grades, and other applications that compel tensile and/or shear strength enhancement of particulate substrate properties. These terms are employed in broad and overlapping fashion in the field, and they are intended to be so understood in this document.

Beginning in the late 1960s in the United States, manufacturers responded to the demands mentioned above by developing rolled erosion control products. Such products, many of which originated in the Netherlands and other parts of Europe, included erosion control nets, geotextiles, erosion control blankets, geosynthetic mattings and other materials formed from natural materials such as straw and jute, as well as from synthetic materials such as polypropylene, polyvinylchloride and nylon.

Broadly speaking, such rolled erosion control products have been classified generally (and frequently imprecisely) into several categories; the industry often employs these categories interchangeably or at least partially coextensively.

First, erosion control nets classically employ two-dimensional woven natural or geosynthetic fibers or extruded plastic meshes to anchor loose-fiber mulches such as straw or hay. Such erosion control nets provide increased performance relative to hydraulically applied mulches and are suitable for moderate site conditions where open weave erosion control geotextiles and erosion control blankets are not indicated.

Second, open weave erosion control geotextiles conventionally include two-dimensional matrices of natural or synthetic yarns or ends. These products provide erosion control with or without the use of mulch and they conventionally display higher tensile strength than erosion control netting. Such products are indicated where higher tensile strength is required, such as on steeper slopes or reinforcing underlying substrate.

Third, erosion control blankets are conventionally formed of various organic or synthetic fibers which may be woven, glued or otherwise structurally connected to nettings or meshes. Common erosion control blankets include three dimensional fibrous matrices of straw, wood, coconut, nylon, polyester, polyethylene, polyvinylidine, polypropylene or other materials which are stitched, glued or otherwise fastened to nets such as erosion control nets. Blankets thus add a third dimension and are indicated at sites which require greater tensile strength and durability. Conventional applications include steep slopes (up to 40°), low to moderate flow channel, and low impact shore linings. Such blankets are conventionally used only where natural, unreinforced vegetation alone is intended ultimately to provide long term soil stabilization and erosion control.

Fourth, geosynthetic mats comprise various synthetic fibers and/or filaments processed into permanent, high strength, three-dimensional matrices. Common products include cuspated polyethylene meshes that are heat bonded together, extruded monofilaments of nylon or PVC heat bonded at intersections, and crimped polyolefin fibers and other materials which are mechanically stitched between high strength nettings. Geosynthetic mats are conventionally designed for permanent and critical hydraulic applications such as drainage channels, where flow velocity and shear stresses exceed the limits of mature, natural vegetation (3 to 20 feet per second). The three dimensional profile and high tensile characteristics of geosynthetic mats entangle plant roots and soils to form a continuous composite. The combination reduces plant dislodgment during high velocity, high shear flows. Accordingly, geosynthetic mats reinforcing vegetation have recently replaced rock, riprap and other nonvegetated lining materials.

Geosynthetic mats may also be employed for turf reinforcement. In such instances, they may be overseeded or underseeded with a prescribed seed mix and/or soil to form the turf-reinforcement mat or the permanent erosion control revegetation mat.

Recently, the Erosion Control Technology Council, which is an organization formed by rolled erosion control products providers, initiated more formal classification for these sorts of products. The categories include low velocity degradable rolled erosion control products ("LVDRECP's"), high velocity degradable RECP's ("HVDRECP's"), and long term nondegradable RECP's ("LTNDRECP's"). LVDRECP's include erosion control nets, single net erosion control geotextiles, and certain erosion control blankets as discussed above. Such products are intended for a service life of one to two growing seasons and resist damage and reduce erosion only to a limited degree. They are typically indicated for slopes that feature moderate grade, length and runoff and low velocity channels where potential for damage during installation and use is minimal.

HVDRECP's include erosion control blankets with double or high strength nets, erosion control nets or erosion control geotextiles with greater strength characteristics. These products feature a service life of approximately one to five years and are indicated for steeper slope protection and higher velocity channel lining applications where natural, unreinforced vegetation is expected to provide permanent soil stabilization.

LTNDRECP's are intended to provide permanent vegetation reinforcement. These products are conventionally and usually nondegradable, high tensile strength geosynthetic mattings.

At another level, earth reinforcement materials have been used to reinforce particulate substrates. These include retaining wall structures such as reinforcement bar or geogrids embedded in soil and/or rock structures. Heavy duty and lighter duty woven natural and synthetic fiber products have also been used for earth reinforcement applications.

Conventionally, choices were forced as a particular application's set of requirements corresponded more closely to an earth reinforcement, turf reinforcement, erosion control or other application, or as those requirements changed or were expected to change over the life span of the site (e.g., erosion control may be important now, turf reinforcement later as a site matures). Erosion control conventionally required rock, riprap, or vegetation reinforced with heavy duty geosynthetic mattings. Lower flow velocities and shallower slopes made such erosion control products uneconomical, and required instead lighter duty geosynthetic mattings, erosion control blankets or perhaps two dimensional open weave geotextiles. Earth reinforcement, by contrast, required grid, heavy duty woven or other high tensile strength structures. The need has accordingly existed for a low cost, versatile product which functions effectively across a broad range of erosion control, turf reinforcement and earth reinforcement applications. Such materials would need to feature the durability approaching rock, riprap or vegetation reinforced geosynthetic mats, while featuring the low cost of lighter duty turf reinforcement materials yet the high tensile strength of earth reinforcement materials.

SUMMARY OF THE INVENTION

The present invention provides geosynthetic mats and structures which are formed, broadly, according to a two step process. A scrim or scrims having desired end count of machine direction and cross machine direction ends, each set of ends of desired thickness, composition, filament count and other desired properties, is woven in an appropriate fashion such as on looms conventionally employed to produce industrial textiles, including but not limited to woven textiles such as shade fabric. Alternatively, the scrim or scrims may be knitted or otherwise formed in a conventional fashion of yarns or fibers having desired thickness, composition, filament count and other desired properties. Conventional or other needle punched staple, continuous filament or spunbonded nonwovens, or knitted geogrids or other fabrics may also serve as such a scrim. The scrim may then be tufted on tufting equipment, such as conventional carpet tufting equipment, with tufted ends of desired weight, thickness, filament count, composition, heat set, treatment such as twisting, plying, spiral wrapping, and other desired properties, and as otherwise desired, to produce three dimensional geosynthetic mats according to the present invention. The mats may be employed in a great variety of erosion control, turf reinforcement and earth reinforcement structures and applications as discussed and shown more fully below.

Structures of the present invention accordingly provide high strength, high durability, low cost three dimensional matrices which may be used alone, without vegetation for erosion control, with vegetation for erosion control and/or turf reinforcement, and for earth reinforcement applications. The structures according to the present invention are counterintuitive; it was thought that the tufting process added to the weaving or knitting process would create an inordinately expensive product which could not compete with heat fused synthetic mats, woven meshes and other conventional erosion control, turf reinforcement, and earth reinforcement products. However, the inventors have found that use of tufting equipment such as conventionally used in the carpet industry, even with the stiff and thick ends tufted according to the present invention, allows low cost, efficient manufacture of these three dimensional products.

The tufted geosynthetic products according to the present invention are extremely flexible, yet feature high tensile strength, high porosity for vegetation capture and soil retention, durability and cost effectiveness. They may be easily transported to the site, unrolled, placed and overseeded or underseeded for turf reinforcement. Likewise, they may be easily embedded in earth structures for earth reinforcement applications in order to provide increased shear strength and other desired properties.

The scrims of products according to the present invention provide favorable tensile and shear strength properties both laterally and longitudinally as desired. Yet the tufted ends add a matrix in the third dimension that includes great numbers of interstices for capturing vegetation and retaining soil, but which allow the product to be surprisingly lightweight when shipped and as being installed. Accordingly, the mats of the present invention feature very favorable tensile strength to density ratios as compared to previous erosion control, turf reinforcement and earth reinforcement products.

Precise control allowed by conventional weaving (or other scrim forming) and tufting machinery on which these mats may be made allows a great deal of control over the composition, dimensions, properties, arrangements, and frequencies of the tufted ends, machine direction ends, and cross machine direction ends (or other yarns or filaments) which form the mats. Accordingly, for such products having woven scrims, enhanced control and management is possible in each of the three dimensions over a broad range of strength, durability, porosity, density, roughness, cost, and other properties of such mats as desired for particular sites and applications. Such control is also provided with other scrim manufacturing processes.

It is accordingly an object of the present invention to provide low cost geosynthetic structures which may be used for erosion control, turf reinforcement, earth reinforcement and a broad variety of other applications.

It is an additional object of the present invention to provide geosynthetic structures which may be economically manufactured such as on conventional carpet tufting machinery, and whose properties in all three dimensions may be varied by changing, among other things, the arrangement, frequency, structure and composition of the constituent machine direction ends, cross machine direction ends, knit yarns, or other scrim yarn, filament or fiber properties and tufted ends as well as the manner and patterns according to which weaving, knitting, or other scrim formation and tufting occurs.

It is an additional object of the present invention to provide geosynthetic structures which may be economically manufactured such as on conventional carpet tufting machinery, and whose properties in all three dimensions may be varied by changing, among other things, taking advantage of close control afforded by weaving, including adjusting the arrangement, frequency, structure and composition of the constituent machine direction ends, cross machine direction ends, and tufted ends as well as the manner and patterns according to which weaving and tufting occurs.

It is an additional object of the present invention to provide erosion control, turf reinforcement and earth reinforcement structures which employ and capitalize on the favorable properties of geosynthetic mats disclosed in this document.

Other objects, features and advantages of the present invention will become apparent with reference to the remainder of this document.

DETAILED DESCRIPTION OF THE DRAWINGS

Figure 1:
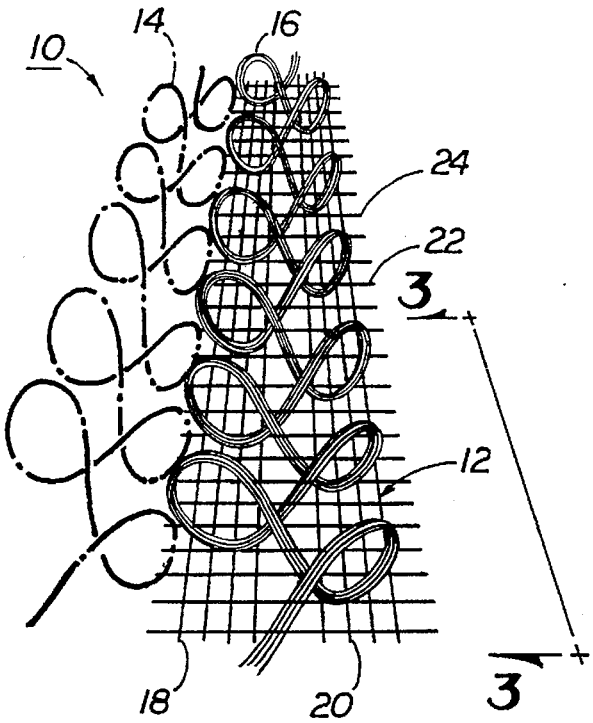
FIG. 1 is a schematic perspective rendering of a preferred embodiment of geosynthetic mat according to the present invention.
Figure 1A:
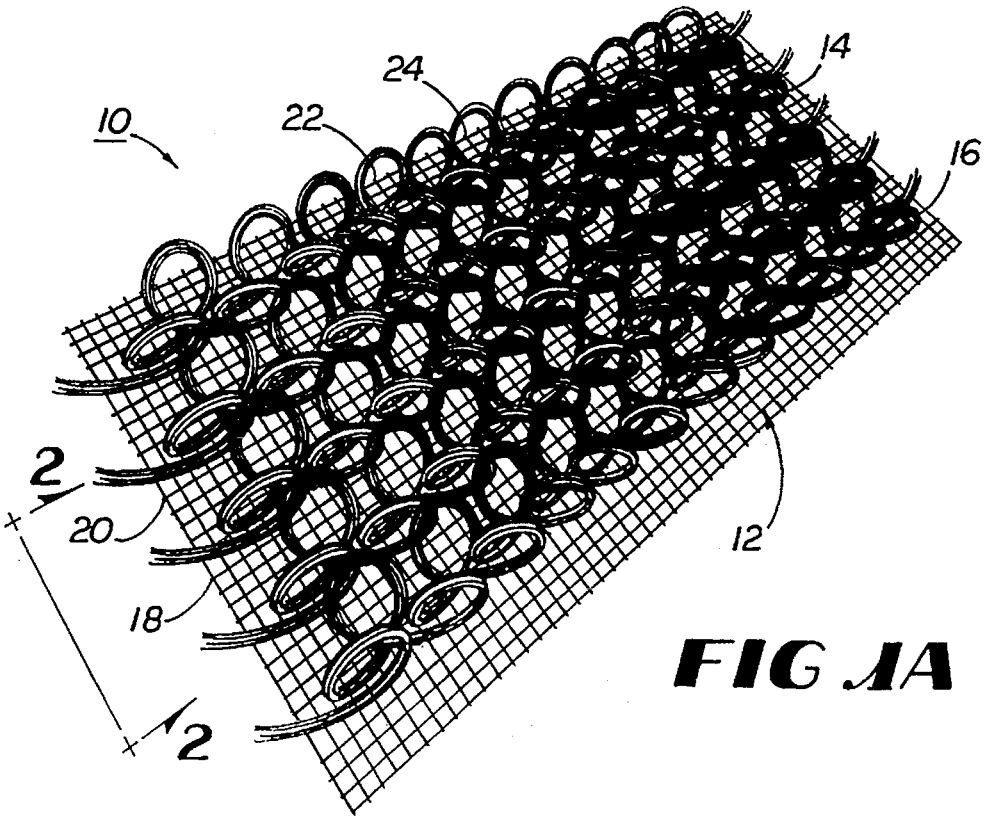
FIG. 1A is a schematic perspective view of the mat of FIG. 1.
Figure 2:
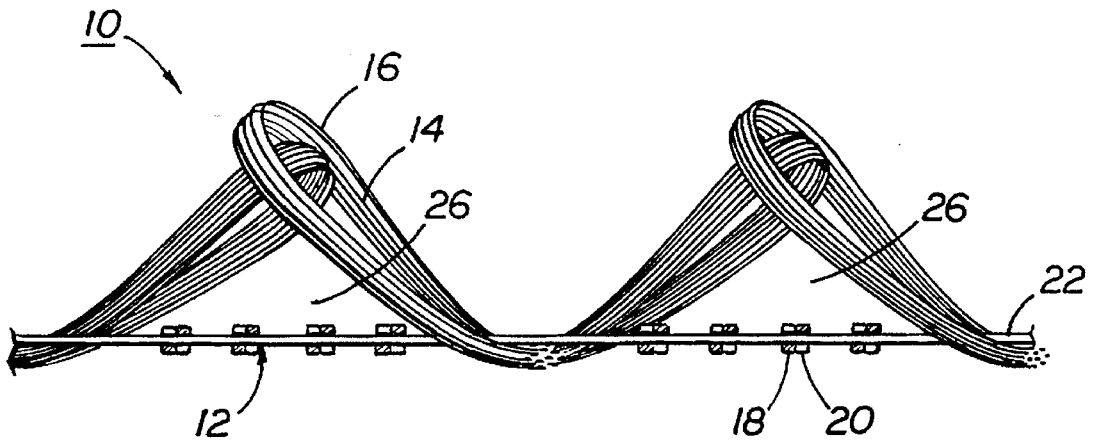
FIG. 2 is a cross sectional view of the mat of FIG. 1A taken along section line 2—2 of FIG. 1A.
Figure 3:
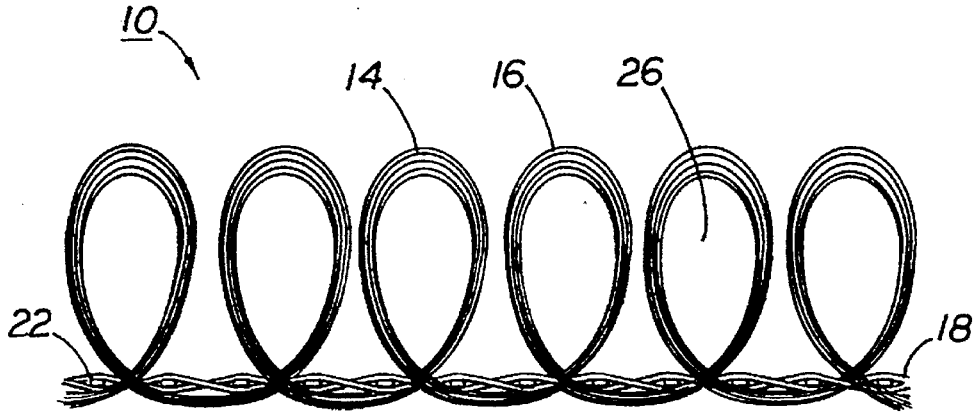
FIG. 3 is a cross sectional view of the mat of FIG. 1 taken along section 3—3 of FIG. 1.

FIGS. 1 and 1A show, in a rendering and schematically, a preferred embodiment of a geosynthetic mat 10 according to the present invention. Mat 10 is generally formed of a scrim 12 which is tufted with a plurality of tufted ends 14.

Scrim 12 in the preferred embodiment may be a conventional woven shade fabric marketed by the Nicolon Mirafi Group of Atlanta, Ga. The scrim 12 is, in the preferred embodiment, woven of a number of machine direction ends 18 and cross machine direction ends 22. The machine direction end 18 count is, in the preferred embodiment, 8 ends per inch and the cross machine direction end 22 count 9 per inch. In the preferred embodiment, machine direction ends 18 have a thickness of approximately 11.5 mils, and cross machine direction ends 22 have a thickness of approximately 11.5 mils. Those ends in the preferred embodiment are formed of machine direction end filaments 20 and cross machine direction end filaments 24, which are extruded polypropylene[;]. Machine direction ends 18 are formed of 2 machine direction ends filaments 20, and cross machine direction ends 22 are formed of 2 cross machine direction end filaments 24. Machine direction ends 18 according to that structure are intertwisted between cross machine direction ends 22, although that need not be the case.

Other woven scrim structures may also be used and the present invention contemplates that they will be used for various applications and sites. Machine direction ends 18 and cross machine direction ends 22 may be alike, or they may be different. Various machine direction ends 18 may be different from each other and arranged in any desired pattern; the same is true for cross machine direction yarns 22. They may be arranged, composed and formed as desired and according to any desired pattern for optimal performance of scrim 12 in one direction (unidirectionally) or more than one (bidirectionally). As an example, scrim 12 for a mat 10 used in embankments may be optimized by increasing end thickness, end tensile strength and/or end count, among other factors in a particular direction. For conventional applications that require favorable tensile strength, shear strength and cost properties, however, it is preferable that the end count for machine direction ends 18 be between 8 and 20 per inch, and cross machine direction ends 22 between 8 and 20 per inch, assuming a size of machine direction ends 18 between substantially 500 and 5000 deniers, and cross machine direction ends 22 of substantially between 500 and 5000 deniers and machine direction ends 18 with a tensile strength between substantially 100 and 6000 lb/in and cross machine direction ends 22 between substantially 100 and 6000 lb/in.

Machine direction ends 18 and cross machine direction ends 22 are preferably formed of synthetic material, most preferably but not limited to polypropylene (extruded). Synthetic materials are critical for the strength, durability, density and cost parameters (not conventionally found in natural fibers) of the present invention in addressing various erosion control, turf reinforcement and earth reinforcement applications. UV stabilizers may also be added. Other synthetic materials which may be used include: polyester, polyethylene, nylon, polyvinylidine and any other suitable plastics or polymeric material.

Scrim 12 may also be formed of any suitable knitted, nonwoven or other structure as desired to provide requisite tensile strength, shear strength, cost, weight, size, air and fluid transmissivity and other desired properties.

Scrim 12, as mentioned above, is tufted with a number of tufted ends 14. This may be accomplished on a conventional carpet tufting machine such as has long been used in the carpet industry. Such machines may be single needle, double needle, or as otherwise desired, and threaded conventionally with tufted ends 14.

Tufted ends 14 in the preferred embodiment, embodiment "8," are formed of a number of tufted end filaments 16, each filament 16 having a thickness of 11.5 mils. In the preferred embodiment, the ends 14 contain 13 filaments 16. The ends 14 may be heat set as desired in order to perform properly for appropriate mat 10 thickness, resilience and density, although heat setting is not necessary. In another embodiment, embodiment "6," the tufted ends 14 are each also formed of 13 filaments 16 of 11.5 mil thickness, again of extruded polypropylene. In a third embodiment, embodiment "10," tufted ends 14 are formed of 13 filaments 16 of 11.5 mil thickness yet again of extruded polypropylene.

Tufted ends 14 are preferably formed of a synthetic material, most preferably polypropylene (extruded). Synthetic materials are critical for the strength, resiliency, durability, density and cost parameters (not conventionally found in natural fibers) of the present invention in addressing various erosion control, turf reinforcement and earth reinforcement applications. UV stabilizers may also be added. Other synthetic materials which may be used include: polyester, polyethylene, nylon, polyvinylidine and any other suitable plastics or polymeric material.

Tables 1–3 show properties of the embodiments discussed above constituting tufted ends 14 as described above tufted as described into a scrim 12 to form mat 10.

TABLE 1

EMBODIMENT 8 PROPERTIES

| Property | Test Method | Unit | | Minimum Average Roll Value |
|---|---|---|---|---|
| Thickness | ASTM D 1777 mod. | inches | | .5 |
| Mass per Unit Area | ASTM D 5261 | oz/yd$^2$ | | 12.7 |
| Wide Width Tensile Strength | ASTM D 4595 | lbs/in | MD | 55 |
| | | | CD | 40 |
| Wide Width Elongation | ASTM D 4595 | % | MD | 20 |
| | | | CD | 12 |
| Light Penetration | Proposed ECTC | % | | 16 |
| Resiliency | Proposed ECTC | % Recovered | | 85 |
| Flexibility | ASTM D 1388(B) | mg-cm | | 6000 |
| Porosity | Calculated | % | | 95 |
| U.V. Resistance after 500 hours | ASTM D 4355 | % | | 90 |
| Limiting Shear Stress (0.5 hrs.) | Bare Soil | lbs/ft$^2$ | | >7.6 |
| Permissible Velocity (0.5 hrs) | Bare Soil | ft/sec | | 20.5 |

TABLE 2

EMBODIMENT 6 PROPERTIES

| Property | Test Method | Unit | | Typical Roll Value |
|---|---|---|---|---|
| Thickness | ASTM D 1777 | inches | | .38 |
| Mass per Unit Area | ASTM D 5261 | oz/yd$^2$ | | 10 |
| Wide Width Tensile Strength | ASTM D 4595 | lbs/in | MD | 55 |
| | | | CD | 40 |
| Wide Width Elongation | ASTM D 4595 | % | MD | 20 |
| | | | CD | 12 |
| Light Penetration | Proposed ECTC | % | | 20 |
| Resiliency | Proposed ECTC | % Recovered | | 85 |
| Flexibility | Proposed ECTC | m/g | | 6000 |
| Porosity | Calculated | % | | 95 |
| U.V. Resistance after 500 hours | ASTM D 4355 | % | | 90 |
| Limiting Shear Stress (0.5 hrs.) | Bare Soil | lbs/ft$^2$ | | * |
| Limiting Shear Stress (50 hrs.) | Bare Soil | lbs/ft$^2$ | | * |

*Data Not Available in testing phase

TABLE 3

EMBODIMENT 10 PROPERTIES

| Property | Test Method | Unit | | Typical Roll Value |
|---|---|---|---|---|
| Thickness | ASTM D 1777 mod. | inches | | 0.8 |
| Mass per Unit Area | ASTM D 5261 | oz/yd$^2$ | | 14 |
| Wide Width Tensile Strength | ASTM D 4595 | lbs/in | MD | 55 |
| | | | CD | 40 |
| Wide Width Elongation | ASTM D 4595 | % | MD | 20 |
| | | | CD | 12 |
| Light Penetration | Proposed ECTC | % | | 15 |
| Resiliency | Proposed ECTC | % Recovered | | 85 |
| Flexibility | ASTM D 1388 (B) | mg-cm | | 6,000 |
| Porosity | Calculated | % | | 90 |
| U.V. Resistance after 500 hours | ASTM D 4355 | % | | 90 |
| Limiting Shear Stress (0.5 hrs.) | Bare Soil | lbs/ft$^2$ | | * |
| Limiting Shear Stress (50 hrs.) | Bare Soil | lbs/ft$^2$ | | * |

*Data Not Available in testing phase

Table 4 shows such data for mats according to the present invention which are formed of nonwoven scrim that has been tufted according to the present invention

TABLE 4

TM8NW TECHNICAL DATA

| Property | Test Method | Unit | | Average Roll Value |
|---|---|---|---|---|
| Thickness | ASTM D 1777 mod. | inches | | 0.6 |
| Mass Per Unit Area | ASTM D 5261 | oz/yd$^2$ | | 19.6 |
| Wide Width Tensile Strength | ASTM D 4595 | lbs/in | MD | 45 |
| | | | CD | 45 |
| Wide Width Elongation | ASTM D 4595 | % | MD | 70 |
| | | | CD | 60 |
| Light Penetration | Proposed ECTC | % | | 1.5 |
| Resiliency | Proposed ECTC | % Recovered | | 85 |
| Porosity | Calculated | % | | >90 |
| U.V. Resistance after 500 hours | ASTM D 4355 | % | | 90 |

Thickness of mats 10 may, but need not be, determined in accordance with ASTM Standard D 1777-64 (Reapproved 1975) which is incorporated herein by this reference. (Thickness data is so determined in the tables presented above and below.) That test determines nominal thicknesses of geotextile and geomembrane materials by observing the perpendicular distance that a movable plane is displaced from a parallel surface by the geotextile or geomembrane material while under a specified pressure, for approximately 5 seconds.

ASTM Standard D 5261-92 (approved Jun. 15, 1992, published August 1992) which is incorporated herein by this reference is preferably employed to determine density or mass per unit area of mats 10. (The tables above and below present data determined according to that standard.) That standard generally determines density or mass per unit area by weighing test specimens of known dimensions, cut from various locations over the width of the laboratory sample; the calculated values are then averaged to obtain the mean mass per unit area or density. Any other suitable test which weighs test specimens of known dimensions and then calculates density or mass per unit area from the weights and dimensions, may be employed.

Tensile strength is preferably determined using ASTM Standard D 4595-86 (approved Sep. 24, 1986, published November 1986) which is incorporated herein by this reference. (That standard is used for the data presented in the tables above and below.) Generally, that test provides that a relatively wide specimen is gripped across its entire width in the clamps of a constant rate of extension (CRE) type tensile testing machine operated at a prescribed rate of extension, applying a longitudinal force to the specimen until the specimen ruptures. Tensile strength, elongation, initial and secant modulus, and breaking toughness of the test specimen can be calculated from machine scales, dials, recording charts, or an interfaced computer. Tensile strength is calculated as the force per unit width to cause a specimen to rupture as read directly from the testing instrument. Any other test which determines the force per unit width to cause a specimen to rupture may also be employed.

Wide width elongation may also be determined according to ASTM Standard D 4595-86 (approved Sep. 24, 1986, published November 1986) which is incorporated herein by this reference. (That test is used for the data presented in the tables above and below.)

Resiliency may be determined according to ASTM Standard D 1777 mentioned above which is incorporated herein by this reference. (That test is used for data presented in the tables above and below.) That test employs a thickness gauge, consisting of a base anvil, a presser plate which provides a 0.10 kPa normal pressure to the test specimen, and a gauge capable of thickness measurement. The sample is measured between the presser plate and anvil, then removed and placed under a constant normal compressive load of 100 pounds per square inch for one minute. The load is repeated for two additional one minute loading intervals and at the conclusion of the loading cycle (three intervals of normal compressive loading), the test specimen is allowed to recover for 30 minutes and then measured in thickness. Recovery is calculated in percentage as final thickness over initial thickness.

Flexibility may be measured according to ASTM Standard D 1388-64 (Reapproved 1975) which is incorporated herein by this reference. (Data presented in the tables above and below are determined according to that standard.) Briefly, a 4-inch×18-inch test specimen, after density measurement such as in accordance with ASTM Standard D 5261 mentioned above, is placed on a testing apparatus that includes a platform measuring 18 inches×12 inches and having a smooth low-friction surface. A distance scale is attached to the platform referenced at an angle of 41.5° below the plane of the platform surface. A metal bar weight measuring 4 inches×18 inches×⅛ inch may be rested on the test specimen during testing. The test specimen is placed on the horizontal platform so that the specimen length is positioned in the direction of the incline. The leading edge of the test specimen is aligned with the leading edge of the horizontal platform and the bar weight is aligned with the leading edge of the test specimen. The test specimen is slid slowly and smoothly over the edge of the horizontal platform until the leading edge of the specimen touches the inclined plane. The overhang length is measured on the distance scale where the leading edge touches. Flex stiffness may be calculated as the third power of half the overhang length. This may be done for each desired direction or orientation in the material.

Light Penetration may be calculated as follows (and is for data in the tables presented above and below) a 12 inch×12 inch sample of mat 10 is placed in a shade box equipped with GE Light Meter 214, which is a schematic view. The distance between the wall on which the bulb is mounted and the diffuser is 12.75 inches. The distance between the diffuser and the hinge in which the fabric fits is 1.5 inches. The distance between the hinge and the wall on which the light meter is mounted is 9.25 inches. (Three test specimens are used for the test). The test specimens are handled in a manner to avoid the loss of loose filler and weaving components. The two chambers (light source and detection) of the shade box are placed together. The light meter is placed on the shelf located in the detection chamber and turned on. The exposed sample edges are covered with non-transparent tape to prohibit non-source light from entering the detection chamber. The bulb is positioned so that the light meter reads 100 foot-candles in an unshaded condition. This maximum light intensity is recorded as $I_m$. The specimen is placed in the specimen slot and the box chambers are shifted together to achieve a snug fit. Again, the exposed sample edges are covered with non-transparent tape to preclude non-source light from entering the detection chamber. A light meter reading is then determined for the specimen, $I_s$. Light penetration is calculated as follows: light penetration=$1-[(I_m-I_s)/I_m]\times 100$. The light penetration for each specimen is recorded and averaged for the sample of three specimens. It can be seen that this light penetration test measures the percentage of light allowed to be transmitted through mat 10; any test that accurately measures percent of light to be transmitted through mat 10 may be employed to determine light penetration.

UV resistance may be determined according to ASTM Standard D 4355-92 (approved Oct. 15, 1992 and published January 1993) which is incorporated herein by this reference. UV resistance is so determined for the data that appear in the tables presented above and below. Briefly, ASTM Standard D 4355 testing is conducted as follows: Specimens of material are exposed for 0 150, 300 and 500 hours of ultraviolet exposure in a xenon-arc device. The exposure consists of 120 minute cycles as follows: 90 minutes of light only, followed by 30 minutes of water spray and light. Five specimens are tested for each total exposure time, in each of the machine and cross directions. Following the exposure time the specimens are subjected to a cut or ravel strip tensile test which is indicative of deterioration.

The permissible velocity test results stated in the tables above are determined as follows. The high-velocity test facility consists of a 4-ft-wide, 48-ft-long flume, which is filled with 18 inches of compacted soil. The material to be tested is anchored onto the soil surface according to manufacturer's specifications. The flume is flat (no slope) and the test material is not placed on the vertical walls, but only on the channel floor.

A "test" in this unit consists of two replications of each of several runs, each at a different water flow amount and velocity. Normally there are flows of about 10, 16, 22.5, 30, and 37.5 cfs for 30 minutes each which translate to velocities of approximately 3, 5, 10, 15 and 20 fps. 50 cfs can also be run at approximately 25 fps for short periods when necessary. On durable materials the runs may start at about 10 fps and extend through 25 fps. Average cross-sectional velocity and flow-depth measurements are made during each run at stations 0, 5, 15, 30, and 45. After each 30-minute run, cross-sectional measurements are made at each 1-ft. width across the channel and every 5 ft . along their lengths to determine erosion locations and depths. Extended runs at any velocity and for any length of time are made when warranted.

Parameters affecting the stability or performance of channel liners include the following: 1) durability of the material, i.e, its ability to withstand erosion by high-velocity water flow; 2) the method and pattern of anchoring or stapling; 3) its compatibility with vegetation growing through it; 4) stability of materials within the mat or blanket itself; and, 5) its susceptibility to natural degradation or disintegration.

Shear test results stated in the tables are determined as follows. The test flume for measuring shear has plexiglass sidewalls and is 2 ft. wide, 2 ft. deep, and 24 ft. long. A 2 ft. by 5 ft. test section is preceded in the channel by a 16 ft. smooth section that allows the turbulent flow to flatten out by the time it enters the instrumented area.

The mat to be tested is fastened to the 10 $ft^2$ test section and a small amount of water is turned into the channel. Velocity readings are taken at upstream and downstream ends of the test section, and the indicated shear value is recorded. Velocity is increased in small increments to a maximum of about 20 fps, and at each increment two velocity measurements are made together with their corresponding shear stress. Shear values are read directly in pounds, and are then converted to 1 $bs/ft^2$. Three replications are run for each test using a new section of mat each time. The shear value is taken as the average of the three replications of measurements made on a given material.

It can be seen that the tufted mats 10 provide a number of interstices 26 which are oriented in three dimensions to yield a relatively thick structure for capturing vegetation, retaining soil, or providing sufficient roughness to control flow of fluids, yet they are of great tensile strength and very light in weight.

As one form of measurement of the openness or high level of interstices in such mats 10, light penetration is used as a value. The first embodiment discussed above has a light penetration value of 16%, while the second exhibits a light penetration value of 20% and the third 15%. Note that the increased thickness and density of mats 10 decreases light transmissivity of mats 10 as reflected in lower light penetration values (e.g., 16% for the midrange embodiment 8 mat, 20% for the thinner and less dense embodiment 6 mat, and 15% for the thicker and denser embodiment 10 mat (as reflected in thickness and mass per unit area values reflected in tables 1–3).

Light penetration value (and corresponding light transmissivity) also serves as a proxy for the important property of mats 10 that they allow penetration by vegetation, particulate matter and water. Scrim or mat which approaches impenetrability by vegetation, particulate matter and/or water detracts from important substrate retention, soil retention, fluid flow, turf reinforcement, and other properties required in a mat 10 of the present invention that is well suited for erosion control, turf retention and earth reinforcement applications. Accordingly, sufficient penetrability, which is reflected in a light penetration value of no less than substantially 5%, is critical to mats 10 according to the present invention.

The mats 10 according to the present invention also have a high tensile strength to density ratio, as shown clearly in the following table which compares such mats 10 to other erosion control and revegetation mats.

TABLE 5

EROSION CONTROL AND REVEGETATION MATS (ECRMs)

| | | 3-DIMENSIONAL POLYOLEFIN MATS3-D PVC MATS | | | | | | | |
|---|---|---|---|---|---|---|---|---|---|
| | Control Section Bare Soil | Coir w/3 Nets NAG C350 | SI 450 | SI 455 | NAG P300P | BonTerra SFB | Tensar 1000 | Tenax Multimat 100 | Tenax Ercon |
| Mass Unit Area (osy) | n/a | 12.7 | 10.0 | 14.0 | 11.2 | 10.0 | 10.0 | 8.8 | 22.6 |
| Thickness (In.) | n/a | 0.63 | 0.40 | 0.50 | 0.56 | 0.30 | 0.40 | 0.70 | 0.40 |
| Wide Width Tensile (lbs/ft) | n/a | 480 × 960 | 145 × 110 | 145 × 110 | 259 | 226 × 144 | 110 × 110 | 548 | — |
| WW Elongation (%) | n/a | 49 × 31 | 50 × 50 | 50 × 50 | — | 32 × 32 | — | 8 | — |
| 2" Strip Tensile (lbs/ft) | n/a | — | 130 × 90 | — | — | — | — | — | — |
| 2" Strip Elongation - Max. (%) | n/a | — | 50 × 30 | — | — | — | — | — | — |
| Porosity (%) | n/a | — | 95 | — | — | 95 | — | — | — |
| Flexibility - Min. (mg-cm) | n/a | — | 10500 | — | — | 15600 | — | — | — |
| Resilience (%) | n/a | — | 80 | — | — | — | — | — | — |
| Light Penetration (%) | n/a | — | 65 | 80 | 93 | — | — | — | — |
| U.V. Stability (%) | n/a | 80 | 90 | 90 | — | 80 | — | — | — |
| Moisture Absorption (%) | n/a | — | .01 | .01 | — | — | — | — | — |
| Color | n/a | Coir | Green | Green | Green | Green | Green | — | — |

| | Miramat | 3-D PVS MATS | | 3-D TUFTED MATS | | |
|---|---|---|---|---|---|---|
| | 1000 | Miramat 1800 | Miramat 2400 | Embod 6 | Embod 8 | Embod 10 |
| Mass Unit Area (osy) | 8.0 | 16.0 | 24.0 | 10.0 | 12.7 | 14.0 |
| Thickness (In.) | 0.25 | 0.16 | 0.25 | 0.38 | 0.50 | 0.80 |
| Wide Width Tensile (lbs/ft) | 132 × 96 | 77 × 20 | 74 × 17 | 660 × 480 | 660 × 480 | 660 × 480 |
| WW Elongation (%) | 11 | 120 | 70 | 20 × 12 | 20 × 12 | 20 × 12 |
| 2" Strip Tensile (lbs/ft) | — | 90 × 30 | 108 × 36 | 660 × 480 | 720 × 720 | 660 × 480 |
| 2" Strip Elongation - Max. (%) | — | 150 × 100 | 150 × 100 | 40 × 24 | 40 × 24 | 40 × 24 |
| Porosity (%) | — | 85 | 85 | 95 | 95 | 90 |
| Flexibility - Min. (mg-cm) | — | 2000 | 2000 | 6000 | 6000 | 6000 |
| Resilience (%) | — | — | — | 85 | 85 | 85 |
| Light Penetration (%) | — | — | — | 20 | 16 | 15 |
| U.V. Stability (%) | — | — | — | 90 | 90 | 90 |
| Moisture Absorption (%) | — | — | — | — | — | — |
| Color | Black | Black | Black | Black | Black | Black |

Table 5 shows a very high tensile strength both in the machine direction and cross machine direction directions form Embodiments 6, 8 and 10 as compared to other erosion control and revegetation mats. In fact, the tensile strength in both directions substantially exceeds that of three-dimensional polyolefin mats and three-dimensional PVC mats of the type commercially provided contemporaneous with the preparation of this document.

Table 6 compares the properties of mats 10 according to the present invention with conventionally provided turf reinforcement mats.

Mats 10 may be shipped in rolls of any desired width and length, preferably on the order of 12 feet wide and 100 feet long. A full roll can easily be handled and installed by two people using the following procedures. First, for site preparation, the surface of the installation area is graded so that the ground is smooth and compact. When seeding prior to installation, the substrate is prepared by loosening two inches to three inches of top soil or particulate matter. All gullies, rills, and any other disturbed areas should be fine graded prior to installation. The seed is broadcast or other-

TABLE 6

TURF REINFORCEMENT MATS (TRMs)

| | Control | ECB w/Heavy Nets | | | 3-D Polyolefin Mats | | | 3-D Nylon Mats | | |
|---|---|---|---|---|---|---|---|---|---|---|
| | Section Bare Soil | Perma Mat 100 | Perma Mat 200F | Bon Terre SFB12 | SI 1060 | SI 1061B | Tensar TM3000 | Enkamat 7010 | Enkamat 7020 | Enkamat 7220 |
| Mass Unit Area (osy) | n/a | 34.0 | 37.4 | 12.0 | 14.0 | 17.0 | 12.0 | 7.3 | 11.1 | 10.9 |
| Thickness (In.) | n/a | — | — | 0.50 | 0.50 | 0.50 | 0.50 | 0.36 | 0.68 | 0.59 |
| Wide Width Tensile (lbs/ft) | n/a | 300 × 300 | 375 × 376 | 280 × 200 | 220 × 165 | 350 × 250 | 120 × 120 | 156 × 65 | 209 × 89 | 154 × 193 |
| WW Elongation (%) | n/a | — | — | 20 | 40 | 85 | — | 45 | 53 | 16 |
| 2" Strip Tensile (lbs/ft) | n/a | — | — | — | 175 × 110 | — | 130 | 190 × 55 | 250 × 120 | 250 × 210 |
| 2" Strip Elongation - Max. (%) | n/a | — | — | — | 40 × 20 | — | 70 | 70 × 80 | 75 × 75 | 50 × 33 |
| Porosity (%) | n/a | — | — | 95 | 96 | — | — | — | — | — |
| Flexibility - Min. (mg-cm) | n/a | — | — | 6070 | 14000 | — | 10000 | — | — | — |
| Resilience (%) | n/a | — | — | — | 80 | — | 90 | — | — | — |
| % of Shading (%) | n/a | — | — | — | 60 | — | — | — | — | — |
| U.V. Stability (%) | n/a | 90 | 90 | 80 | 90 | 90 | — | — | — | — |
| Moisture Absorption (%) | n/a | — | — | — | .01 | — | — | — | — | — |
| Color | n/a | Natural | Green | Green | Black | Black | Black | Black | Black | Black |

| | Woven Mat | 3-D Tufted Mats | | |
|---|---|---|---|---|
| | SI Pyramat | Embod 6 | Embod 8 | Embod 10 |
| Mass Unit Area (osy) | 14.0 | 10.0 | 12.7 | 14.0 |
| Thickness (In.) | 0.50 | 0.38 | 0.50 | 0.80 |
| Wide Width Tensile (lbs/ft) | 3000 × 2200 | 660 × 480 | 660 × 480 | 660 × 480 |
| WW Elongation (%) | 45 | 20 × 12 | 20 × 12 | 20 × 12 |
| 2" Strip Tensile (lbs/ft) | — | 660 × 480 | 660 × 480 | 660 × 480 |
| 2" Strip Elongation - Max. (%) | — | 40 × 24 | 40 × 24 | 40 × 24 |
| Porosity (%) | — | 95 | 95 | 95 |
| Flexibility - Min. (mg-cm) | — | 6000 | 6000 | 6000 |
| Resilience (%) | — | 85 | 85 | 85 |
| % of Shading (%) | 95 | 20 | 16 | 15 |
| U.V. Stability (%) | — | 90 | 90 | 90 |
| Moisture Absorption (%) | — | — | — | — |
| Color | Black | Black | Black | Black |

Again, it can be seen that the tensile strength in both the machine direction and cross machine direction directions far exceeds that of erosion control products with heavy mats, three-dimensional polyolefin mats and three-dimensional nylon mats, and is exceeded only be another woven mat.

Performance of mats 10 as shown in these tables may be characterized in a tensile strength/density ratio, such as, for instance, wide width tensile strength (1 bs/ft) (such as that of ASTM Standard D 4595 recited above) divided by mass per unit area or density (oz/square yard) (such as that of ASTM Standard D 1777 (mod) recited above). The machine direction ratio ranges between 66 and 47.14 as shown in these Tables Five and Six (27.55 for nonwoven material as shown in Table Four) which demonstrates the high strength, both laterally and longitudinally, per unit of mass. The cross machine direction rations range between 48 and 34.28 as shown in Tables Five and Six (27.55 as shown in Table 4.). This strength is obviously important in earth reinforcement, erosion control and revegetation applications, particularly at grade and where durability counts. The lightweight nature of the mats 10 allows for easy installation and great flexibility in optimizing erosion control and turf reinforcement.

wise spread before mat installation for erosion control, preferably, and after mat installation for turf reinforcement. All large rocks, dirt clods, stumps, roots, grass clumps, trash and other obstructions should be removed from direct contact with the substrate and the mat.

Figure 5:
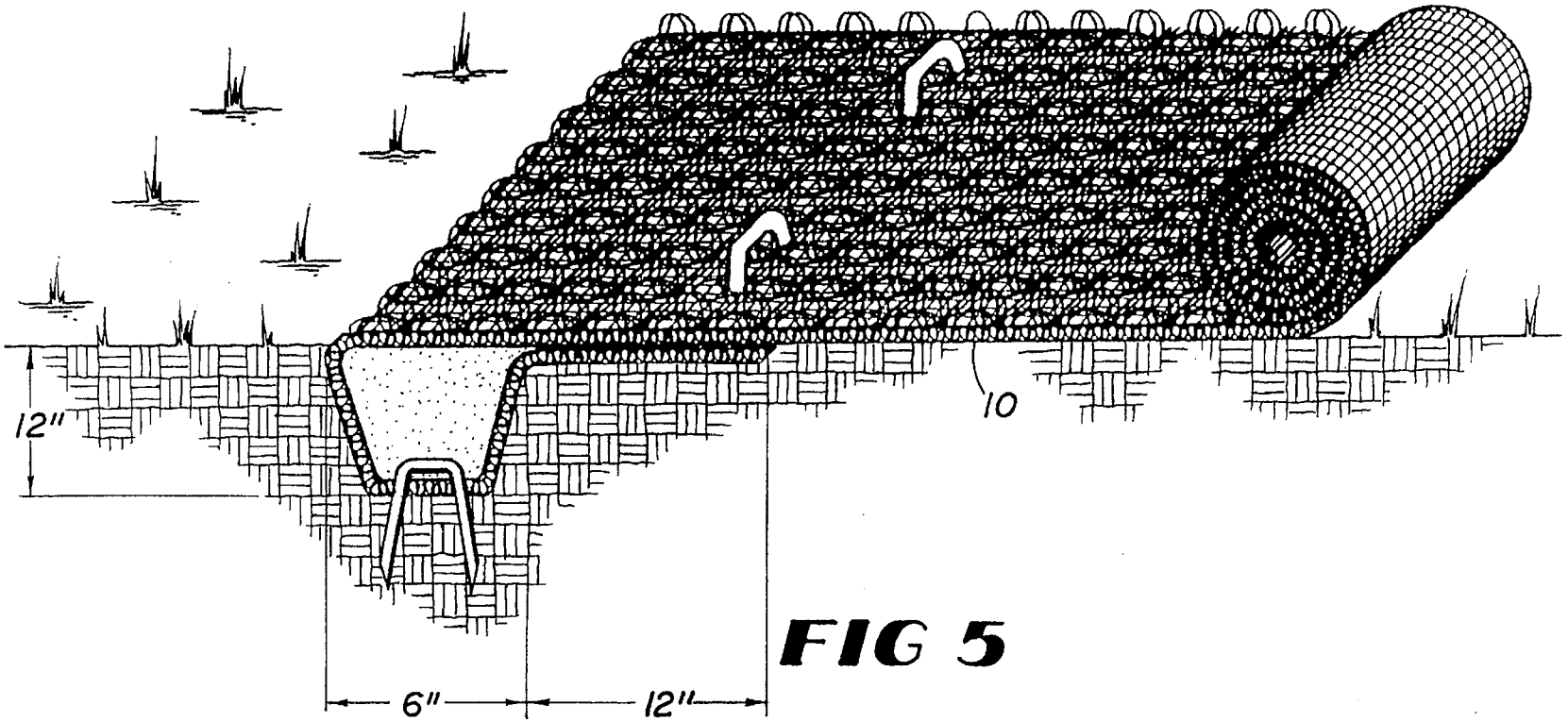
FIG. 5 is a schematic perspective view of initial trench installation of geosynthetic mat of the present invention.
Figure 6:
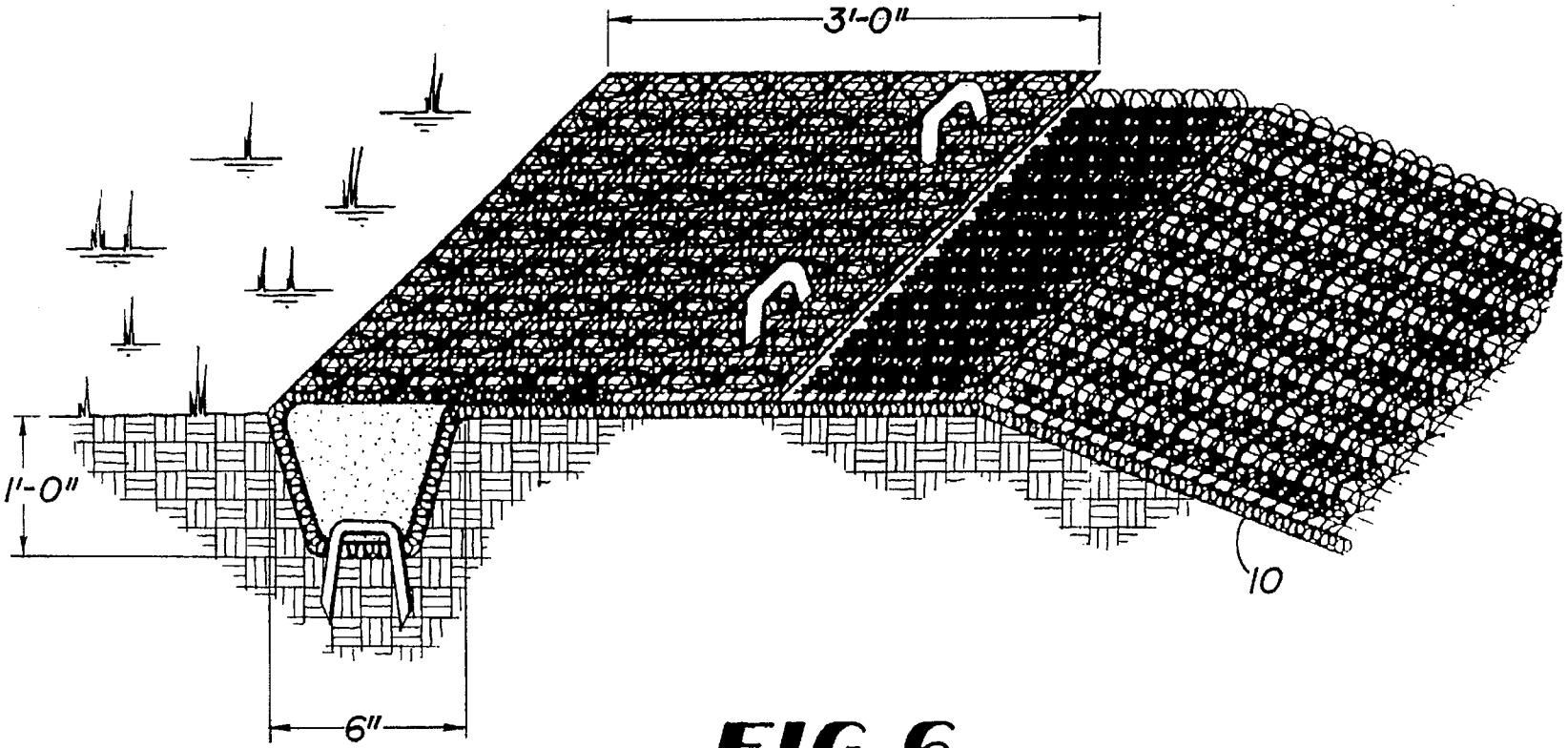
FIG. 6 is a schematic perspective view of terminal anchor trench installation of geosynthetic mat of the present invention.
Figure 7:
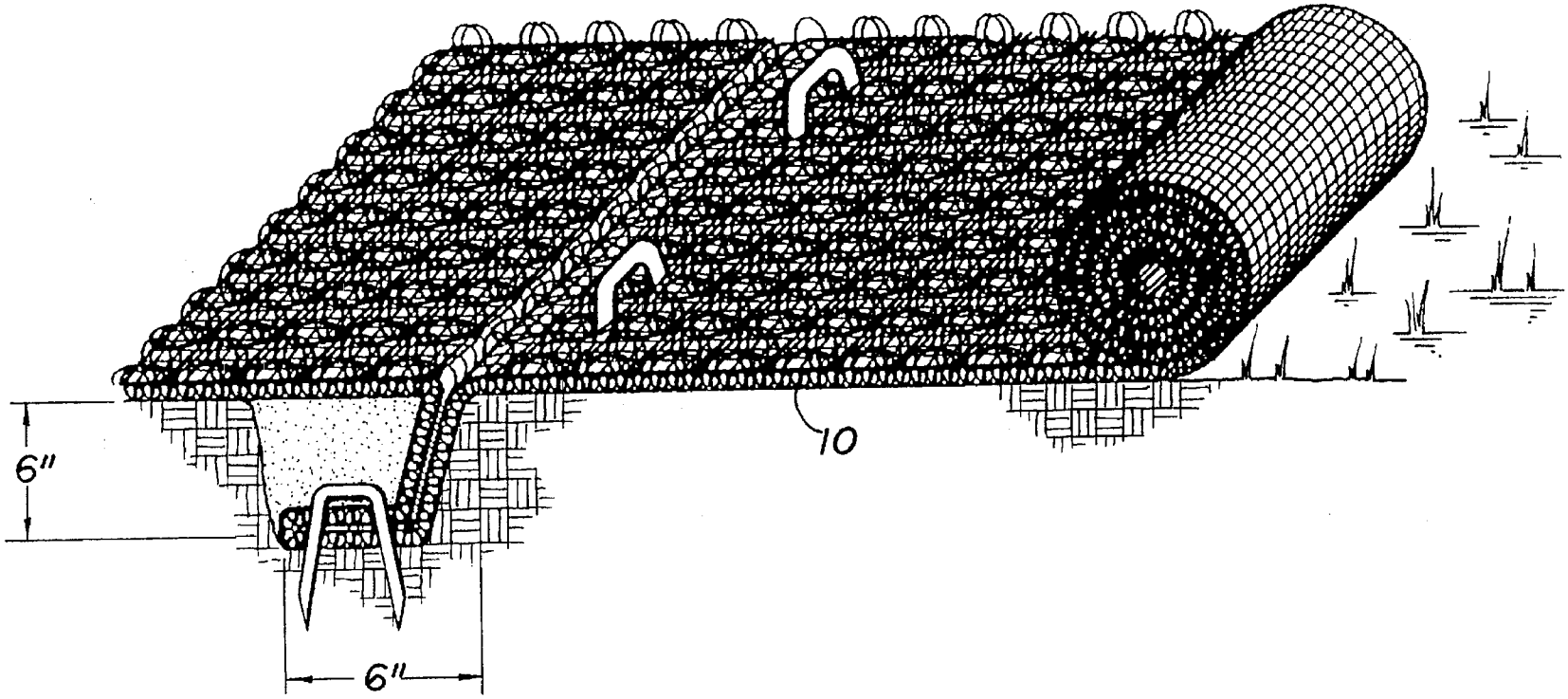
FIG. 7 is a schematic perspective view of intermittent trench installation of geosynthetic mat of the present invention.

Conventional terminal anchor trenches are preferred at mat 10 ends and intermittent trenches should be constructed across channels at 40 foot intervals. See FIGS. 5–7. Initial and terminal anchor trenches should be a minimum of 12 inches deep and 6 inches wide, while intermittent trenches should be on the order of 6 inches deep and 6 inches wide.

Figure 8:
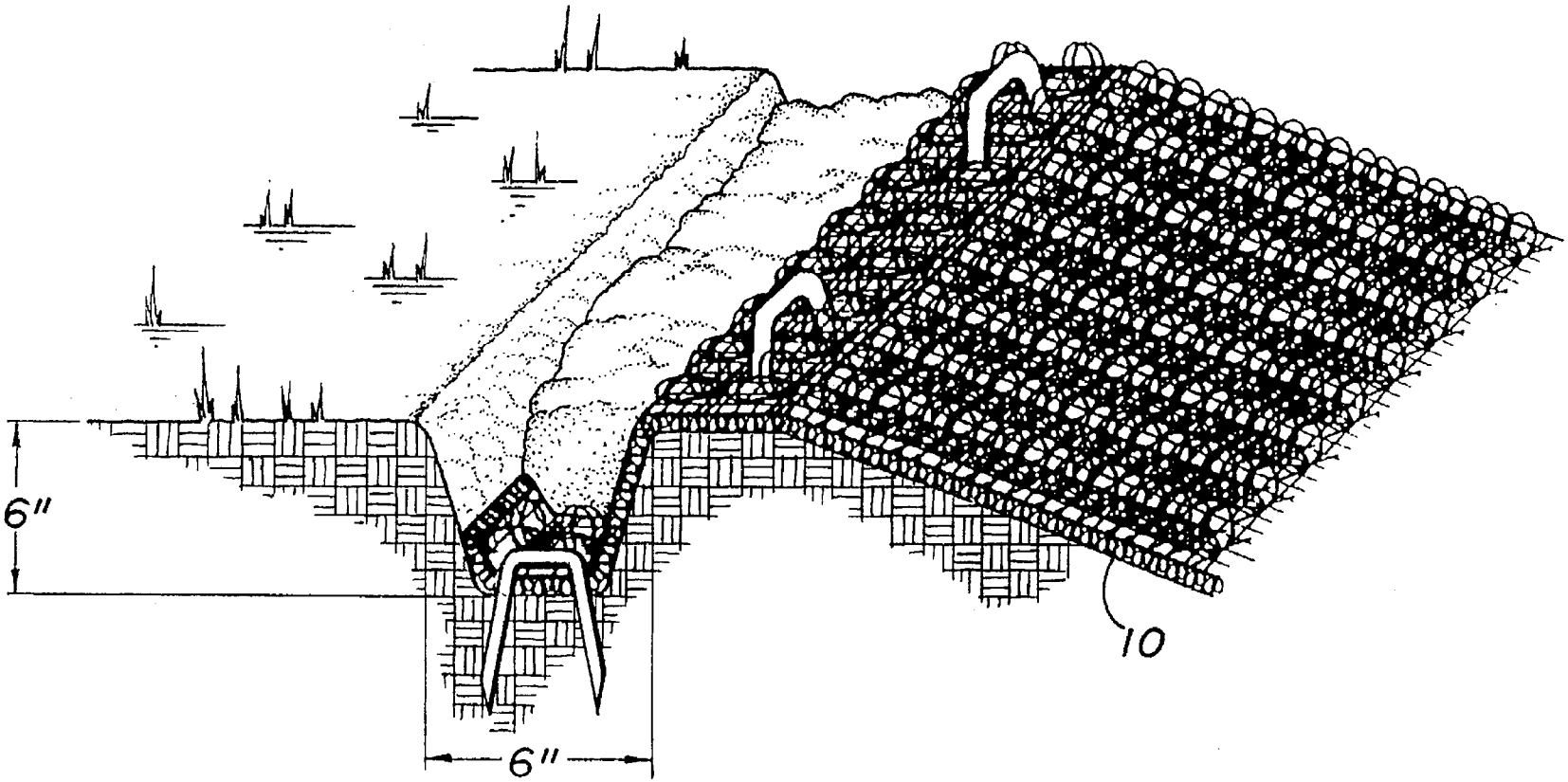
FIG. 8 is a schematic perspective view of longitudinal trench installation of geosynthetic mat of the present invention.
Figure 9:
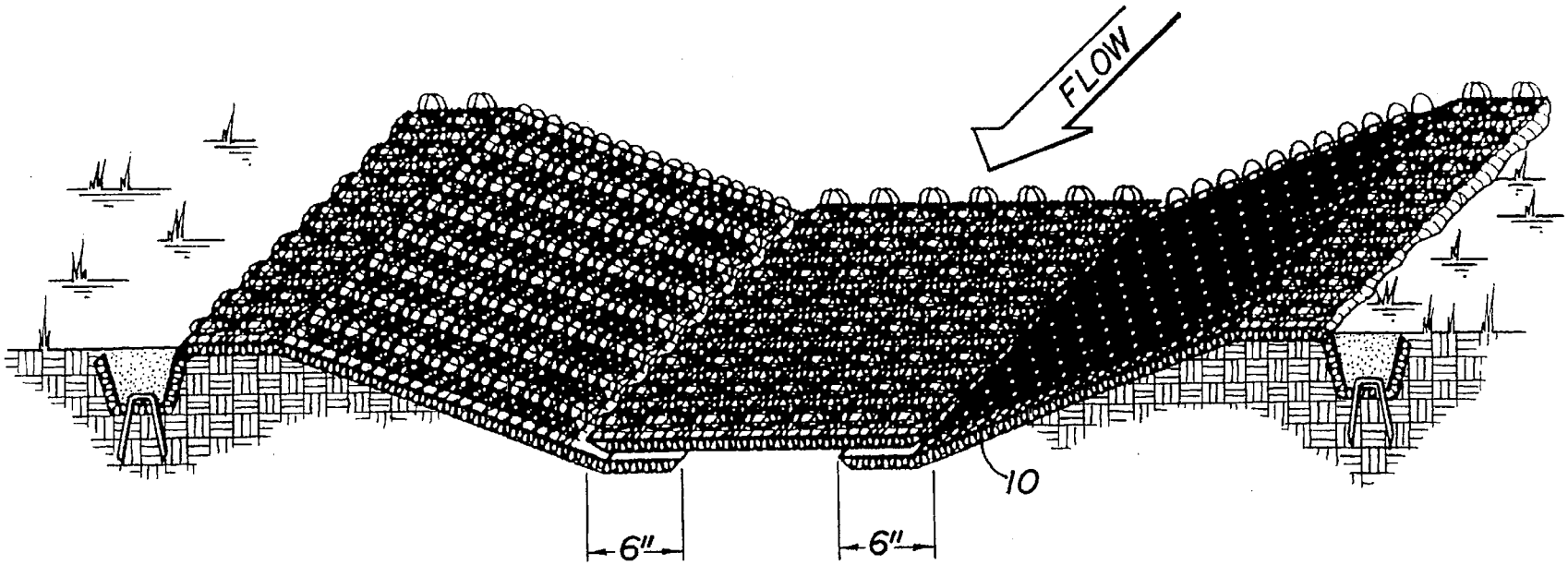
FIG. 9 is a schematic perspective view of typical channel overlap of geosynthetic mat of the present invention.

For channels, the following installation process is preferred. Excavate terminal trenches (preferably 12 inches deep and 6 inches wide) across the channel at the upper and lower end of the lined channel sections and excavate intermittent trenches (preferably 6 inches wide and deep) across the channel at 40 foot intervals. Excavate longitudinal trenches (preferably 6 inches deep and wide) along channel edges in which to bury the outside mat 10 edges. Place the first mat at the downstream end of the channel. Place the end of the first mat in the terminal trench and pin it at 1 foot intervals along the bottom of the trench. Note, that in channels, mat 10 should be placed upside down in the trench, so that the tufted ends 14 are against the ground (particulate substrate), with the roll on the downstream side of the trench. Once pinned and backfilled, the mat is deployed by wrapping over the top of the trench and unrolling upstream with the tufted ends 14 now facing up. See FIG. 5. If the channel is wider than 12 feet, place ends of adjacent rolls in the terminal trench, overlapping the adjacent rolls a minimum of approximately 6 inches. Side-slope shingling should be avoided. See FIG. 9. Pin at 1 foot intervals, backfill and compact. Unroll mat 10 in the upstream direction until reaching the first intermittent trench. Unroll the mat 10 back over itself, positioning the roll on the downstream side of the trench, and allowing the mat to conform to the trench. Then, pin the mat (two layers, preferably) to the bottom of the trench, backfill and compact. See FIG. 8. Continue up the channel (wrapping over the top of the intermittent trench) repeating this step at other intermittent trenches, until reaching the upper terminal trench. At the upper terminal trench (see FIG. 6), allow the mat to conform to the trench, secure it with pins or staples in a conventional way, backfill, compact, and then bring the mat back over the top of the trench and onto the existing mat (2 feet to 3 feet overlap in the downstream direction), and pin at 1 foot intervals across the mat. When starting installation of a new roll, begin in a trench or shingle-lap ends of rolls (in a conventional fashion) a minimum of 1 foot with upstream mat 10 on top to prevent uplifting. Place the outside edges of the mats in longitudinal trenches, pin, backfill, and compact.

For slopes, place mat 10 approximately 2 feet to 3 feet over the top of the slope and into an excavated trench measuring approximately 6 inches deep and 6 inches wide. Pin the mat at 1 foot intervals along the bottom of the trench, backfill, and compact. Mat placement in the trench is accomplished as described above, for channels. Unroll the mat down the slope maintaining intimate contact between the soil or substrate and the smooth side of the mat (tufted ends 14 up). Overlap adjacent rolls a minimum of approximately 6 inches. Pin the mat to the ground using staples or pins in a 3 foot pattern. Less frequent stapling/pinning is acceptable on moderate slopes.

The following are suggested as appropriate securing devices. Eleven gauge, 6 inch×1 inch×6 inch metal staples or 18 inch pins, having 3/16 inch shank and diameter and an attached 1½ inch washer are recommended (but not necessary) for fastening mats 10 to the ground. Drive the staples or pins so that the top of the staple or washer is flush with ground surface. Staple or pin each mat every 3 feet along its center. Longitudinal overlaps should be a minimum of 3 inches and uniform along the entire length of the overlap and stapled or pinned every 3 feet (approximately) along the overlap length. Roll ends may be spliced by overlapping 1 foot (in the direction of water flow), with the upstream mat placed on top of the downstream mat. This overlap should be secured by staples or pins at 1 foot spacing across the mat.

EXAMPLE 1

At a certain airport, two drainage catch basins had been installed parallel to one of the runways. The first catch basin was approximately 25 feet from the concrete edge and the other was 100 feet at the bottom of a sloped channel. Due to the runoff from the runway, erosion and sediment loss occurred and deposited into the basins, preventing any opportunity to establish vegetation. A mat 10 constructed of the preferred embodiment shown in Table 1 (Embodiment 8) above was installed as follows on such particulate substrate, in order to retain seed and soil, stimulate seed germination, accelerate seeding development, and perhaps most importantly synergistically to mesh with plant roots and chutes to anchor this turf reinforcement matrix permanently to the soil surface. The area was first raked to prepare for the installation and the terminal trenches were dug. The initial anchor trench was approximately 12 inches deep and 6 inches wide at the lower end of the project. The mat 10 was placed 3 feet up the slope, placed into the trench, pinned, filled with dirt, then unrolled up the slope to the next trench. The material was placed in the next trench and pinned with two layers together, filled with dirt, and continued up the slope until the terminating trench. The material was placed into the trench, pinned, filled with dirt, and then 3 feet were brought over the top and pinned. Pinning of the complete mat was accomplished at 3 foot intervals. The soil was seeded prior to placement of the mat with rye/fescue mixture. Vegetation occurred within seven (7) days of placement. Thus, mat 10 provided an extremely green, flexible revetment in a classic erosion control and turf reinforcement application.

FIGS. 4–10 show mats 10 placed in various erosion control, turf reinforcement, earth reinforcement, veneer reinforcement and other applications. FIGS. 4A–4F show mats 10 according to the present invention installed along roadway ditches, in storm channels, on bridge abutments, at pipe outlets, for turf reinforcement and for landfill slide slope, respectively. The mats 10 have been installed generally in accordance with the installation instructions described above. In roadway ditches and storm channels, the interstices 26 within mats 10 provide spaces not only to enhance vegetation and retain particulate matter such as soil and gravel, but also to add a roughness coefficient to slow the flow of water and thus prevent erosion on the underlying particulate substrate. For bridge abutments, the sloped turf reinforcement and the landfill side slope sites shown generally in FIGS. 4C, 4E, and 4F, the great tensile strength of mats 10 provide a strong and easily installed erosion control and turf reinforcement system, yet the thickness and three dimensional matrices created by the tufted interstices allow maximum vegetation and retention of root structure.

Figure 4A:
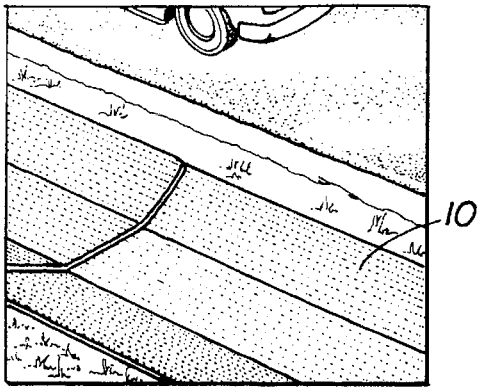
FIG. 4A is a perspective view of geosynthetic mat of the present invention used in a roadway ditch erosion control/turf reinforcement application.
Figure 4B:
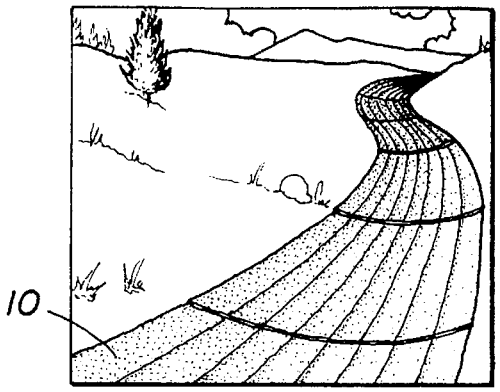
FIG. 4B is a perspective view of geosynthetic mat of the present invention disposed in a storm channel erosion control/turf reinforcement application.
Figure 4C:
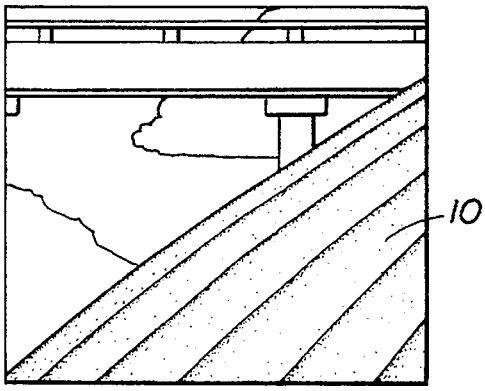
FIG. 4C is a perspective view of geosynthetic mat of the present invention disposed on a bridge abutment in an erosion control/turf reinforcement application.
Figure 4D:
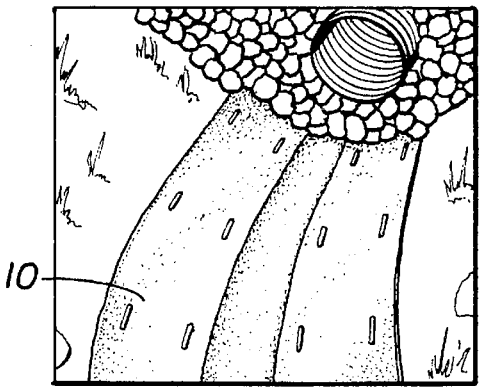
FIG. 4D is a perspective view of geosynthetic mat according to the present invention disposed at a pipe outlet in an erosion control/turf reinforcement application according to the present invention.
Figure 4E:
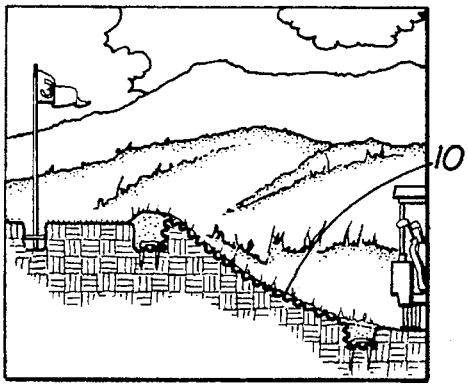
FIG. 4E is a cross sectional view of geosynthetic mat of the present invention disposed in a turf reinforcement application.
Figure 4F:
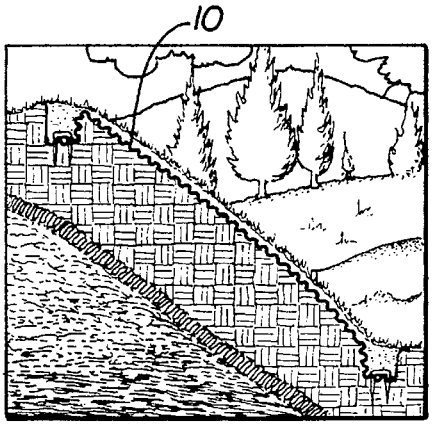
FIG. 4F is a perspective view of geosynthetic mat of the present invention disposed on a landfill side slope in an erosion control/turf reinforcement application.
Figure 4G:
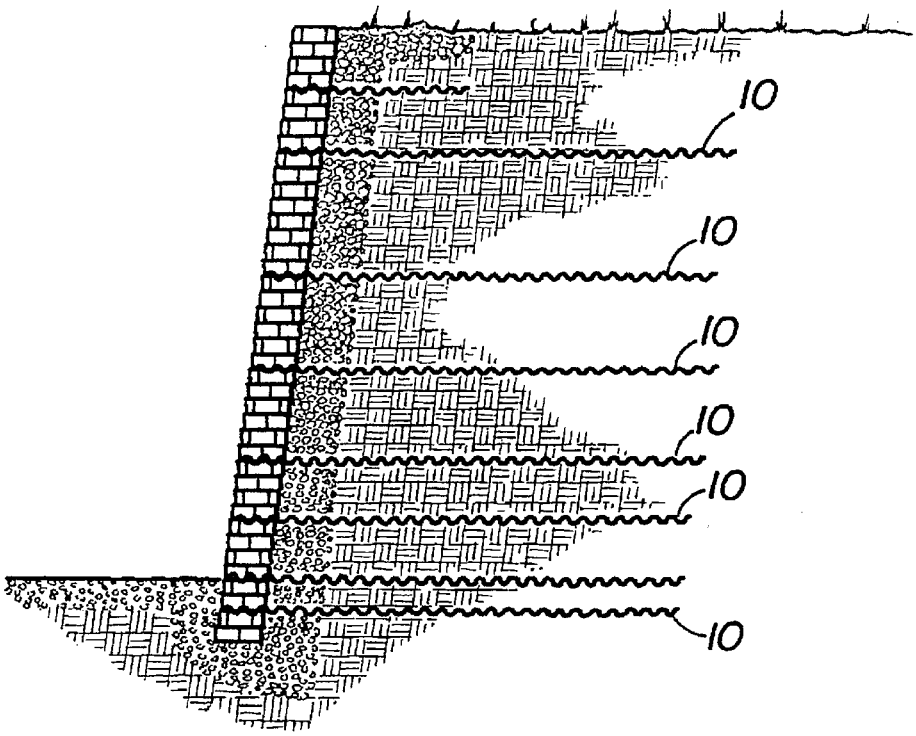
FIG. 4G is a cross sectional view of geosynthetic mat of the present invention employed in an earth reinforcement/retaining wall structure.

FIG. 4G shows mats 10 according to the present invention in a reinforced earth/retaining wall structure. Mats 10 are connected to the retaining wall itself and extend back into the earth being retained to grip against substrata and overstrata of particulate material below and above the mats 10 respectively. The substrata and overstrata of particulate matter thus act vertically upon themselves to retain the retaining wall in place, by virtue of the great tensile strength properties of the mats 10 according to the present invention, combined with their great coefficient of friction created by tufted ends 14 and the interstices 26 resulting therefrom. The mats 10 may be installed in such structures in conventional fashion, similar to the manner in which geogrids and other erosion control rolled products have been installed.

Figure 4H:
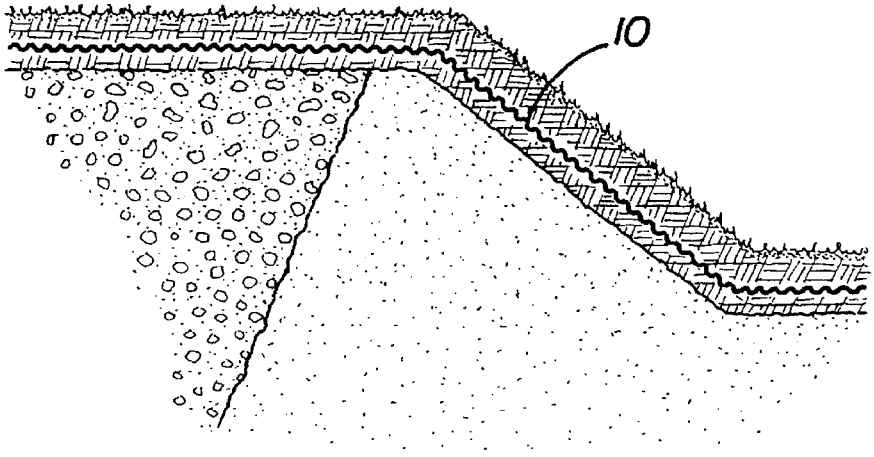
FIG. 4H is a cross sectional view of geosynthetic mat of the present invention employed in a landfill closure veneer reinforcement civil engineering structure.

FIG. 4H shows a veneer reinforcement application for mats 10 such as in a landfill. There, mats 10 may be placed adjacent to impermeable membranes to provide a strength layer combined with a friction layer in order to retain cover overstrata atop the waste containment structure, or for other purposes.

FIGS. 5–9 show initial trench, terminal anchor trench, intermittent trench, longitudinal trench and typical channel overlap installation and applications as discussed above.

Figure 10A:
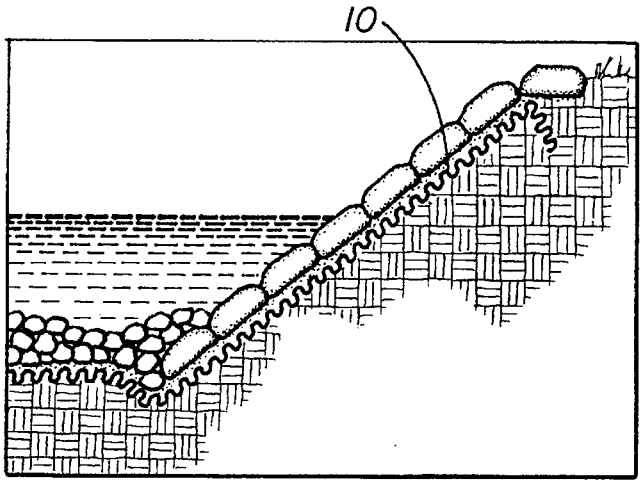
FIG. 10A shows geosynthetic mat according to the present invention in a shoreline erosion control application overlain by concrete or rock revetment.

FIG. 10A shows mats 10 in a shoreline erosion control application placed atop a particulate substrate and then overlain with concrete or rock revetment. In such structures, concrete revetment products may be integrally molded with or cast to mats 10, or otherwise attached to mats 10 by virtue of their great tensile strength. Mats 10 in such applications act effectively for soil retention, and also as a filter fabric in order to distribute soil appropriately with water flow.

Figure 10B:
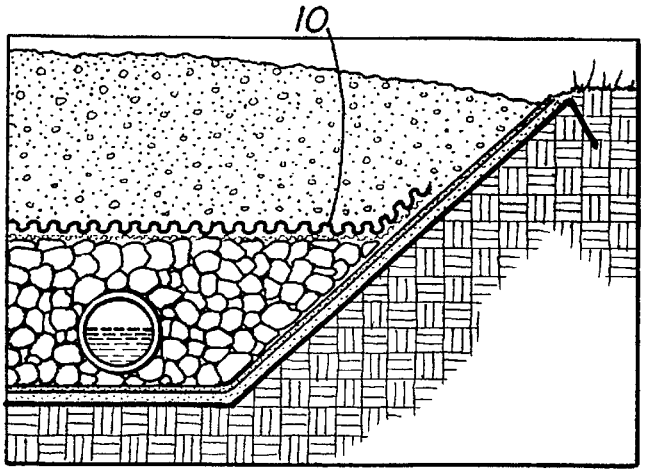
FIG. 10B shows geosynthetic mat according to the present invention employed in a filter application as part of a leachate collection system within a landfill.

FIG. 10B shows mats 10 according to the present invention within a leachate collection system within a landfill. There, mats 10 act as a filter fabric by virtue of the interstices formed by tufted ends 14, combined with the great tensile strength of the woven structure of the scrim 12. Mats 10 in such applications are placed on a first substrate such as a particulate substrate or rock/gravel, and then overlain with a second layer, which may be a particulate overstratum, or gravel/rock. Mats 10 may also function as a strength member in such applications as shown atop a liner along the edges of the collection system within the landfill. There, mats 10 are placed adjacent to, in this case atop, an impermeable liner or membrane, which itself is placed adjacent to or atop the particulate substrate or ground soil.

Figure 10C:
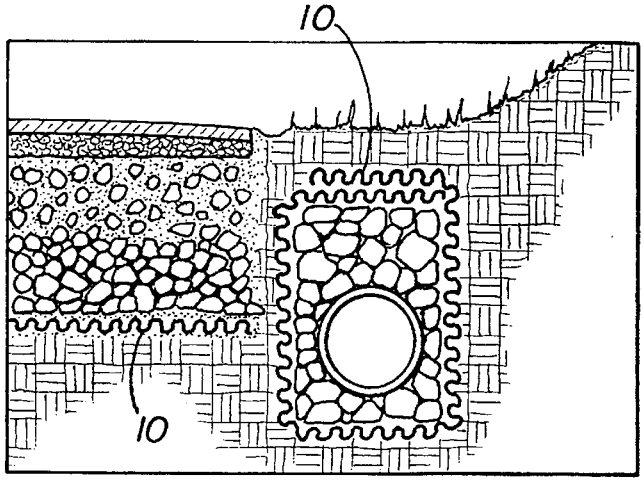
FIG. 10C shows geosynthetic mat according to the present invention employed in another filter application, a cut-off interceptor drain along roadway.

FIG. 10C shows mats 10 acting in a similar filter fabric/strength member capacity within a cutoff/interceptive drain along a roadway or other critical structure.

Figure 11:
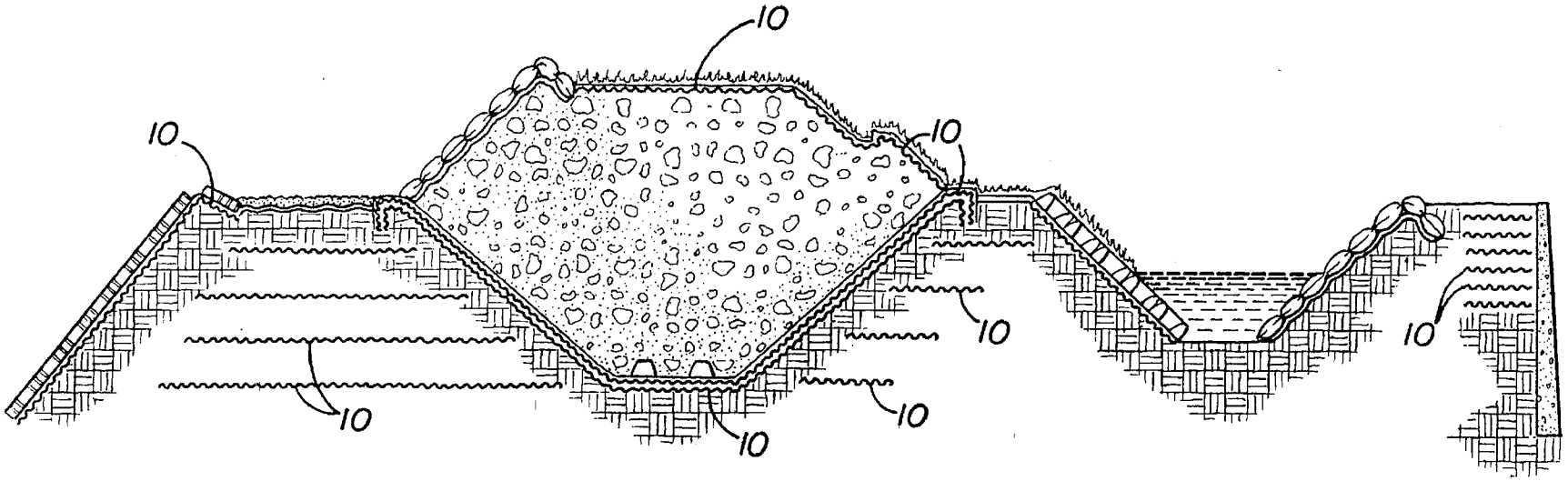
FIG. 11 schematically shows geosynthetic mat according to the present invention employed in various erosion control, turf enforcement, earth reinforcement, filter and other applications.
Figure 12:
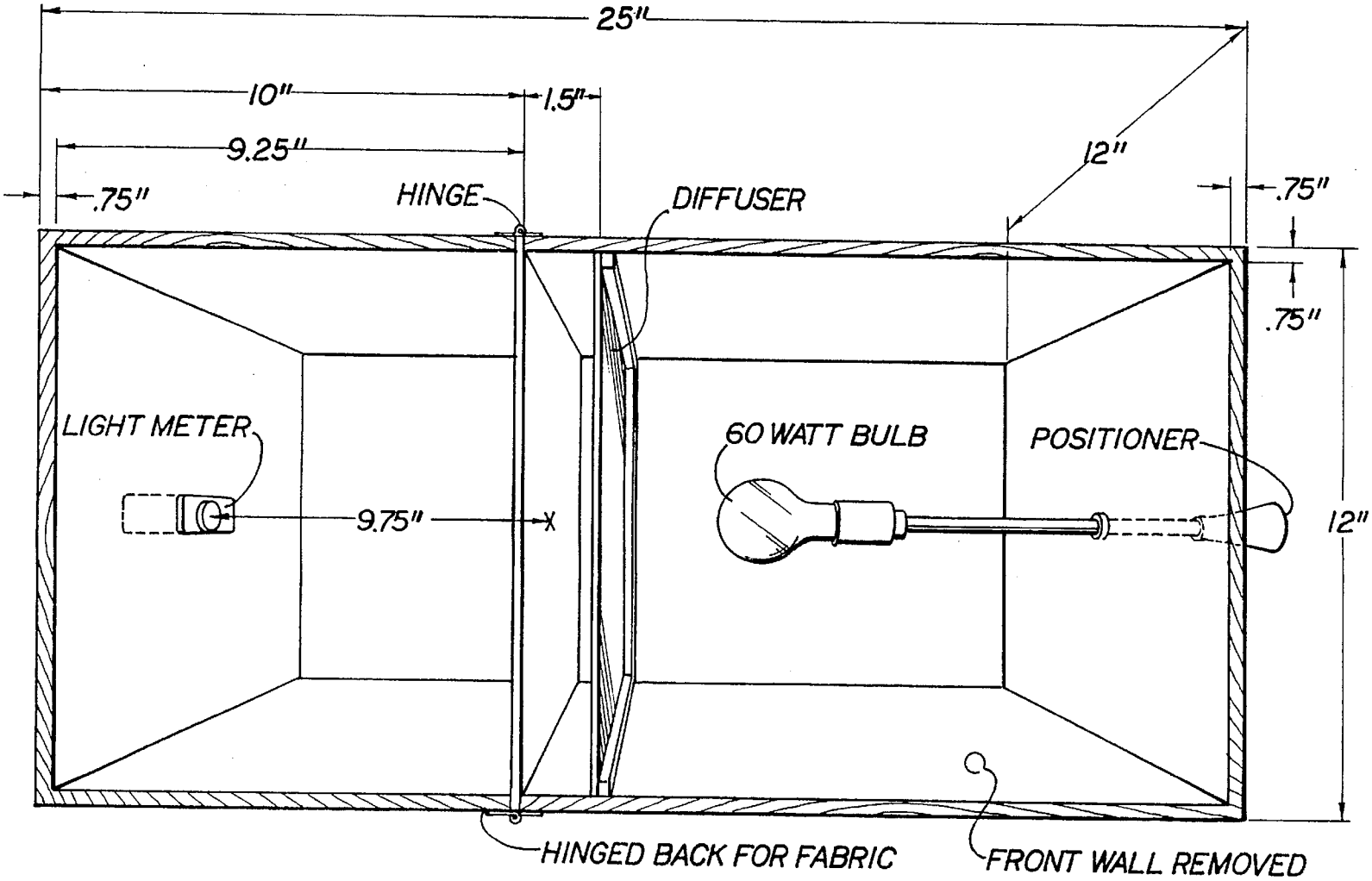
FIG. 12 schematically shows an apparatus for testing light penetration of geosynthetic mats according to the present invention.

FIG. 11 shows the great versatility of mats 10 by virtue of their porosity, roughness, low density, and great tensile strength in both lateral and longitudinal directions. As shown in that schematic drawing, mats 10 may perform earth reinforcement, erosion control, turf reinforcement and many other functions in the form of retaining articulating concrete blocks, forming reinforced earth structures, acting as veneer reinforcement, being placed for revegetation and erosion control, acting as a cap liner, retaining steepened slopes, and acting as part of a base liner in a waste containment facility.

Perhaps one of the greatest benefits afforded by tufted mats 10 according to the present invention is that they may be custom formed on conventional shade fabric weaving and then carpet tufting machinery to control tensile strength in two directions, porosity, roughness, resiliency, light penetration and any other desired characteristics in each of three dimensions by controlling composition, filament counts and properties, thickness properties, end counts, tufting counts, patterns of varying arrangements, types and sizes of ends, (and any other desired property or characteristic) of each of machine direction yarns, cross machine direction yarns, and tufted yarns. Conveniently, this can largely be done by adjusting the settings on, and controlling the processes carried out by the conventional weaving and tufting machinery (and can thus be done automatically such as under software control). Thus, mats 10 may be optimized with great flexibility for a particular application at minimum cost. It is therefore to be understood that a plethora of various permutations and combinations of such scrim 12, machine direction end 18, cross machine direction end 22 and tufted end 14 compositions, structures, arrangements, properties, frequencies, and other factors may be employed to provide mats 10 according to the present invention which serve a broad variety of erosion control, earth reinforcement and turf reinforcement applications, all remaining within the scope and spirit of this invention.

What is claimed is:

1. A geosynthetic structure comprising:

a. a substrate of particulate material;

b. a layer of tufted geosynthetic mat disposed on the substrate of particulate material, comprising a scrim formed of a plurality of synthetic ends, the scrim tufted with a plurality of synthetic tufted ends, with each tufted end forming a coil tufted to the scrim, each coil including a repeated pattern of loops, each repeated pattern of loops defining a plurality of interstices for capturing vegetation and retaining soil whereby the interstices are oriented in three dimensions to create a light penetration of no less than substantially 1.5%; and c. vegetation rooted at least partially in the substrate of particulate material and extending at least partially through the interstices in the layer of tufted geosynthetic mat.

2. A structure according to claim 1 in which the layer of geosynthetic mat features a machine direction tensile strength (in pounds per foot) to density (in ounces per square yard) ratio of between substantially 27.5 and 66.

3. A structure according to claim 1 in which the layer of geosynthetic mat features a cross machine direction tensile strength (in pounds per foot) to density (in ounces per square yard) ratio of between substantially 27.5 and 48.

4. A structure according to claim 1 in which the layer of geosynthetic mat features machine and cross machine direction tensile strength (in pounds per foot) to density (in ounces per square yard) ratio of between substantially 27.5 and 66.

5. A structure according to claim 1 in which the tufted ends comprise a plurality of filaments.

6. A geosynthetic structure comprising:

a. a substrate of particulate material;

b. a layer of tufted geosynthetic mat disposed on the substrate of particulate material, comprising a woven scrim formed of a plurality of synthetic cross machine direction ends and a plurality of synthetic machine direction ends, the scrim tufted with a plurality of synthetic tufted ends with each tufted end forming a coil tufted to the scrim, each coil including a repeated pattern of loops, each repeated pattern of loops defining a plurality of interstices for capturing vegetation and retaining soil whereby the interstices are oriented in three dimensions to create a light penetration of no less than substantially 15%; and c. vegetation rooted at least partially in the substrate of particulate material and extending at least partially through the interstices in the layer of tufted geosynthetic mat.

7. A structure according to claim 6 in which the layer of geosynthetic mat features a machine direction tensile strength (in pounds per foot) to density (in ounces per square yard) ratio of between substantially 47 and 66.

8. A structure according to claim 6 in which the layer of geosynthetic mat features a cross direction tensile strength (in pounds per foot) to density (in ounces per square yard) ratio of between substantially 34 and 48.

9. A structure according to claim 6 in which the layer of geosynthetic mat features machine and cross machine direction tensile strength (in pounds per foot) to density (in ounces per square yard) ratio of between substantially 34 and 66.

10. A structure according to claim 6 in which the cross machine ends and the machine ends are structurally the same.

11. A structure according to claim 6 in which the machine ends are intertwisted between cross machine ends.

12. A structure according to claim 6 in which the machine ends and the cross machine ends are extruded filaments having a thickness substantially at least 11.5 mils.

13. A structure according to claim 6 in which the tufted ends are between 1 and 30 ply of filaments having a thickness substantially at least 11.5 mils.

14. A structure according to claim 6 in which the tufted ends comprise a plurality of filaments.

15. A geosynthetic structure comprising:

a. a substrate of particulate material;

b. a layer of tufted geosynthetic mat disposed on the substrate of particulate material, comprising a woven scrim formed of a plurality of cross machine direction ends and a plurality of machine direction ends, both machine and cross machine ends comprising filaments having a thickness of substantially at least 11.5 mils; the scrim tufted with a plurality of tufted ends comprising between substantially 1 and 30 ply of filaments, each filament having a thickness of at least substantially 11.5 mils, with each tufted end forming a coil tufted to the scrim, each coil including a repeated pattern of loops, each repeated pattern of loops defining a plurality of interstices for capturing vegetation and retaining soil whereby the interstices are oriented in three dimensions to create a light penetration between substantially 15% and 20%; and exhibits a cross machine and machine direction tensile strength (in pounds per foot) to density (in ounces per square yard) ratio of between substantially 34 and 66; and c. vegetation rooted at least partially in the substrate of particulate material and extending at least partially through the interstices in the layer of tufted geosynthetic mat.

16. A geosynthetic structure comprising:

a. a substrate of particulate material;

b. a layer of tufted geosynthetic mat disposed on the substrate of particulate material, comprising a woven scrim formed of a plurality of synthetic cross machine direction ends and a plurality of synthetic machine direction ends, the scrim tufted with a plurality of synthetic tufted ends, with each tufted end forming a coil tufted to the scrim, each coil including a repeated pattern of loops, each repeated pattern of loops defining a plurality of interstices for capturing vegetation and retaining soil whereby the interstices are oriented in three dimensions to create a light penetration of no less than substantially 15%; and c. an overstratum of particulate material disposed on the layer of tufted geosynthetic mat, at least some of the particulate material of the overstratum captured and retained within the interstices formed in the layer of tufted geosynthetic mat.

17. A structure according to claim 16 in which the layer of geosynthetic mat features a machine direction tensile strength (in pounds per foot) to density (in ounces per square yard) ratio of between substantially 47 and 66.

18. A structure according to claim 16 in which the layer of geosynthetic mat features a cross machine direction tensile strength (in pounds per foot) to density (in ounces per square yard) ratio of between substantially 34 and 48.

19. A structure according to claim 16 in which the layer of geosynthetic mat features cross machine and machine direction tensile strength (in pounds per foot) to density (in ounces per square yard) ratio of between substantially 34 and 66.

20. A structure according to claim 16 in which the cross machine ends and the machine ends are structurally the same.

21. A structure according to claim 16 in which the machine ends are intertwisted between cross machine ends.

22. A structure according to claim 16 in which the machine ends and the cross machine ends comprising filaments that have a thickness of at least substantially 11.5 mils.

23. A structure according to claim 16 in which the tufted ends are between 1 and 30 ply of filaments having a thickness of at least substantially 11.5 mils.

24. A structure according to claim 16 in which the tufted ends comprise a plurality of filaments.

25. A geosynthetic structure comprising:

a. a substrate of particulate material;

b. a layer of tufted geosynthetic mat disposed on the substrate of particulate material, comprising a woven scrim formed of a plurality of cross machine direction ends and a plurality of machine direction ends, both machine and cross machine ends comprising filaments having a thickness of at least substantially 11.5 mils; the scrim tufted with a plurality of tufted ends comprising between substantially 1 and 30 ply of filaments, each filament having a thickness of at least substantially 11.5 mils, and each tufted end forming a coil tufted to the scrim, each coil including a repeated pattern of loops, each repeated pattern of loops defining a plurality of interstices for capturing vegetation and retaining soil whereby the interstices are oriented in three dimensions to create a light penetration between substantially 15% and 20%; and exhibits a cross machine and machine direction tensile strength (in pounds per foot) to density (in ounces per square yard) ratio of between substantially 34 and 66; and c. an overstratum of particulate material disposed on the layer of tufted geosynthetic mat, at least some of the particulate material of the overstratum captured and retained within the interstices formed in the layer of tufted geosynthetic mat.

26. A civil engineering structure comprising:

a. a substrate of particulate material;

b. a layer of tufted geosynthetic mat disposed on the substrate of particulate material, comprising a woven scrim formed of a plurality of synthetic cross machine direction ends and a plurality of synthetic machine direction ends, the scrim tufted with a plurality of synthetic tufted ends, with each tufted end forming a coil tufted to the scrim, each coil including a repeated pattern of loops, each repeated pattern of loops defining a plurality of interstices for capturing vegetation and retaining soil whereby the interstices are oriented in three dimensions to create a light penetration of no less than substantially 15%; and c. at least one retaining structure formed of concrete material attached to the layer of tufted geosynthetic mat and disposed to retain at least a portion of the substrate of particulate material.

27. A structure according to claim 26 in which the retaining structure formed of concrete is cast to the layer of tufted geosynthetic mat.

28. A structure according to claim 26 in which the retaining structure comprises at least one retaining wall component.

29. A structure according to claim 26 in which the retaining structure comprises at least one earth stabilization block.

30. A structure according to claim 26 in which the tufted ends comprise a plurality of filaments.

31. A civil engineering structure comprising:

a. a substrate of particulate material;

b. a layer of tufted geosynthetic mat disposed adjacent to the substrate of particulate material, comprising a woven scrim formed of a plurality of synthetic cross machine direction ends and a plurality of synthetic machine direction ends, the scrim tufted with a plurality of synthetic tufted ends, with each tufted end forming a coil tufted to the scrim, each coil including a repeated pattern of loops, each repeated pattern of loops defining a plurality of interstices for capturing vegetation and retaining soil whereby the interstices are oriented in three dimensions to create a light penetration of no less than substantially 15% and features cross machine and machine direction tensile strength (in pounds per foot) to density (in ounces per square yard) ratio of between substantially 34 and 66; and c. at least one membrane which is substantially impermeable to liquid, which membrane is disposed adjacent to the layer of tufted geosynthetic mat.

32. A structure according to claim 31 in which the tufted ends comprise a plurality of filaments.

33. A filter structure comprising:

a. a substrate of particulate material;

b. a layer of tufted geosynthetic mat disposed on the substrate of particulate material, comprising a woven scrim formed of a plurality of synthetic cross machine direction ends and a plurality of synthetic machine direction ends, the scrim tufted with a plurality of synthetic tufted ends, with each tufted end forming a coil tufted to the scrim, each coil including a repeated pattern of loops, each repeated pattern of loops defining a plurality of interstices for capturing vegetation and retaining soil whereby the interstices are oriented in three dimensions to create a light penetration of no less than substantially 15% and features cross machine and machine direction tensile strength (in pounds per foot) to density (in ounces per square yard) ratio of between substantially 34 and 66; and c. at least one layer of crushed rock material disposed on the layer of tufted geosynthetic mat.

34. A structure according to claim 33 in which the tufted ends comprise a plurality of filaments.

* * * * *

UNITED STATES PATENT AND TRADEMARK OFFICE

CERTIFICATE OF CORRECTION

PATENT NO. : 5,651,641
DATED : July 29, 1997
INVENTOR(S) : Thomas C. Stephens et al It is certified that error appears in the above-indentified patent and that said Letters Patent is hereby corrected as shown below:

Column 1, line 67, delete "up to 40°" and insert --up to 45°--

Column 13-14, table 6, column Perma Mat 200F, delete "375 x 376" and insert --375 x 375--

Column 13-14, table 6, column SI 1060, delete "96" and insert --95--

Column 13-14, table 6, column Embod 10, delete "95" and insert --90--

Signed and Sealed this

Second Day of May, 2000

*Attest:*

Q. TODD DICKINSON

*Attesting Officer*

*Director of Patents and Trademarks*